US006122932A

United States Patent [19]

Guillard

[11] Patent Number: 6,122,932

[45] Date of Patent: Sep. 26, 2000

[54] COMBINED INSTALLATION OF A FURNACE AND AN AIR DISTILLATION APPARATUS AND PROCESS FOR USING THE SAME

[75] Inventor: Alain Guillard, Paris, France

[73] Assignee: L'Air Liquide, Societe Anonyme pour l'Etude et l'Exploitation des Procedes Georges Claude, Paris Cedex, France

[21] Appl. No.: 09/236,270

[22] Filed: Jan. 22, 1999

[30] Foreign Application Priority Data

Jan. 23, 1998 [FR] France ..... 98 00723

[51] Int. Cl.[7] ..... F25J 1/00

[52] U.S. Cl. ..... 62/643; 62/915

[58] Field of Search ..... 62/915, 643

[56] References Cited

U.S. PATENT DOCUMENTS 4,485,310 11/1984 de Valroger ..... 290/52

5,244,489 9/1993 Grenier ..... 75/466

5,317,862 6/1994 Rathbone ..... 62/915

5,582,036 12/1996 Drnevich et al. ..... 62/915

*Primary Examiner*—Ronald Capossela

*Attorney, Agent, or Firm*—Young & Thompson

[57] ABSTRACT

A method and apparatus for the combined operation of a furnace and an air distillation apparatus. The air distillation apparatus comprises at least one medium pressure column and a mixing column supplying oxygen to the furnace. The furnace and the distillation apparatus are supplied by a same blower, the mixing column receiving air compressed by a compressor coupled to a cryogenic turbine expanding with work a fluid from the distillation apparatus. The compressor/turbine assembly is coupled to and receives auxiliary power from an auxiliary power source.

9 Claims, 1 Drawing Sheet

COMBINED INSTALLATION OF A FURNACE AND AN AIR DISTILLATION APPARATUS AND PROCESS FOR USING THE SAME

CROSS REFERENCE TO RELATED APPLICATION

This application corresponds to French application 98 00723 of Jan. 23, 1998, the disclosure of which is incorporated herein by reference.

FIELD OF THE INVENTION

The present invention relates to combined installations of at least one furnace, typically a metal treatment furnace, supplied with compressed air by at least one blower, and at least one air distillation apparatus, also supplied at least in part by said blower, supplying oxygen to the furnace and comprising at least one medium pressure column and a mixing column.

BACKGROUND OF THE INVENTION

An installation of this type is disclosed in U.S. Pat. No. 5,244,489 to GRENIER, to which reference will be had for more details and the disclosure of which is incorporated herein by reference. In this document, the compressor for air supplied to the mixing column is driven by a low temperature turbine expanding the part of the air flow directed to the medium pressure column, into an arrangement requiring, to carry out the necessary compression, expanding with work a large portion of the air supplied to the medium pressure column, giving rise to losses of output and energy as well as overdimensioning of the means for refrigeration and purification of the air supplied to the distillation apparatus.

SUMMARY OF THE INVENTION

The present invention has for its object to provide a combined installation of the type mentioned above, permitting reduced cost of operation and with a greater flexibility as to choice of the ranges of operation.

To do this, according to one characteristic of the invention, the assembly of the compressor/low temperature turbine is coupled to an auxiliary assistance member.

The present invention also has for its object to provide a process for operating a combined installation comprising at least one furnace and an air distillation apparatus, including at least one medium pressure column and a mixing column, and supplied with air under a pressure $P_1$ by at least one blower, in which a portion of the air supplied by the blower is diverted to supply the air distillation apparatus and in which a portion of this diverted air is further compressed to supply the mixing column, by a compressor coupled to at least one cryogenic turbine expanding with work a fluid of the installation and serving particularly to cool the distillation apparatus, in which supplemental energy is supplied to the compressor/cryogenic turbine assembly to maintain in the mixing column a pressure $P_2$ greater than at least $0.3\times10^5$ Pa relative to the pressure $P_1$, without having to remove for work expansion a large part of the air flow supplying the medium pressure column.

According to a more particular characteristic of the invention, the supplemental work is supplied by an electric motor coupled to the shaft of the compressor/turbine assembly.

Supplementing compressor/turbine assemblies has been known for a long time, particularly to supplement the turbo-compressors of internal combustion engines (see U.S. Pat. No. 4,485,310 to VALROGER or more recently U.S. Pat. No. 5,560,208 to HALIMI et al., with electrical supplement, or U.S. Pat. No. 4,622,817 to KOBAYASHI, with hydraulic supplement). The state of the art on the other hand teaches nothing about the uses of distillation supply apparatus according to the present invention.

BRIEF DESCRIPTION OF THE DRAWINGS

Other characteristics and advantages of the present invention will become apparent from the following description of one embodiment, given by way of illustration but in no ways limiting, with respect to the accompanying drawing, in which.

DETAILED DESCRIPTION OF THE INVENTION

Figure 1:
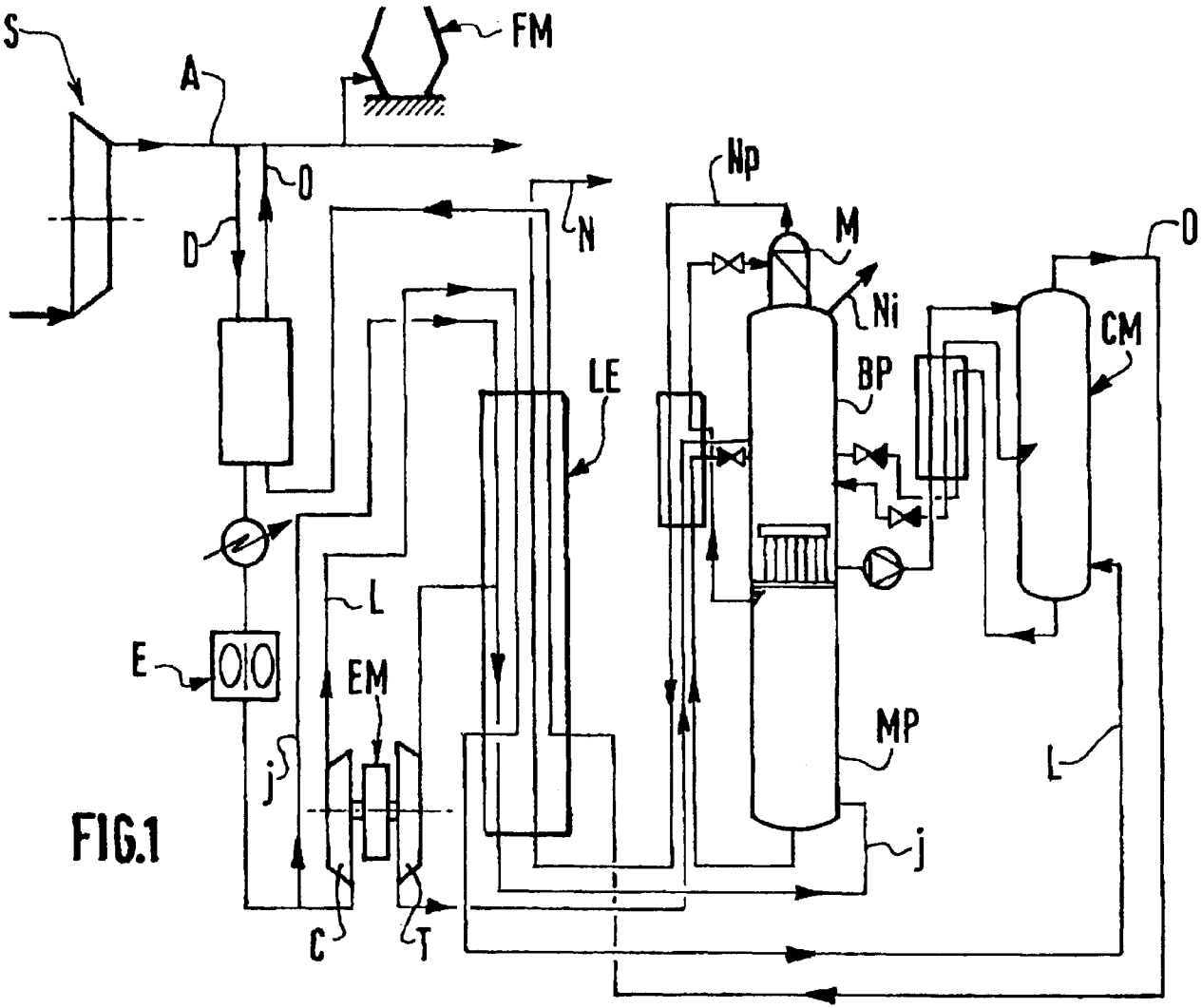
FIG. 1 is a schematic view of a combined installation according to the invention.

In FIG. 1, there is shown schematically a metal treatment furnace, in this instance a blast furnace (FM), and an associated air distillation apparatus comprising essentially, in the example shown, a principal heat exchange line LE, a double column with a medium pressure column MP and a low pressure column BP, and a mixing column CM.

From the top of the mixing column CM, there is withdrawn through a conduit O medium purity oxygen which, according to the invention, after passing through the heat exchange line LE, flows into the principal compressed air line upstream of the furnace FM to enrich in oxygen the air supplied to this latter. Conventionally, from the top of the low pressure column BP extends an impure nitrogen line $N_i$. As a modification, in the illustrated embodiment, the low pressure column BP is surmounted by a minaret M using as reflux liquid nitrogen from the column MP and producing at its top pure nitrogen removed through a line $N_P$ for use on site or in the vicinity of this latter.

The furnace FM and the distillation apparatus are supplied with pure air by a same blower S emptying into a principal compressed air line A supplying at least the furnace FM with a high volume of air (typically greater than 100,000 $Nm^3/h$) under a mean pressure $P_1$ below $6\times10^5$ Pa, typically between $3\times10^5$ Pa and $5.5\times10^5$ Pa. The line A can also supply, simultaneously or alternately, another metal treatment furnace, for example an electric furnace operating according to the AOD process. From the principal line A there is separated an air supply circuit D supplying the distillation apparatus with air that is cooled and then purified in a purification apparatus E, typically of the adsorption type. Downstream of this purification apparatus E, the circuit D divides into a first line J for supplying the double column and a second line L for supplying air to the mixing column CM.

According to one aspect of the invention, a portion of the air flow in the line J is diverted to the heat exchange line LE and is expanded with work in a cryogenic turbine T to be introduced into the low pressure column BP at the low pressure of this latter. The turbine T is coupled to a compressor C disposed in the line L to compress air from the blower and to send it to the mixing column CM at a pressure $P_2$ greater than pressure $P_1$ by about $0.3\times10^5$ Pa and less than $1.5\times10^5$ Pa, typically comprised between $0.4\times10^5$ Pa and $0.8\times10^5$ Pa. According to one aspect of the invention, the compressor/turbine assembly C-T is supplemented by at least one motor EM coupled to the shaft of the C-T assembly. The motor EM is electrical or hydraulic, as described in the above patents. In practice, the added energy is of the order of 30 to 500 kW, according to the characteristics of the combined installation and is inversely proportional to the pressure delivered by the blower S.

Although the present invention has been described in relation to a particular embodiment, it is not thereby limited but on the contrary is adapted for modifications and variations which will be apparent to those skilled in the art whilst remaining within the scope of the following claims.

What is claimed is:

1. A combined installation of at least one furnace and of at least one air distillation apparatus, comprising at least one blower having one output line connected to the furnace for supplying blast air to it, said air distillation apparatus comprising a medium pressure column having an air inlet, a mixing column having an air input and an oxygen outlet connected to the furnace for supplying oxygen thereto, and a feed air line derived from said output line and divided into a first feed air conduit connected to the air inlet of the medium pressure column and to an expansion circuit including a turbine, and into a second feed air conduit connected to the air input of the mixing column and including a booster coupled to said turbine in the expansion circuit, the booster and the turbine further coupled to an auxiliary driving apparatus.

2. The installation of claim 1, wherein the auxiliary driving apparatus comprises at least one electric motor.

3. The installation of claim 2, wherein the distillation apparatus comprises a heat exchange line through which the first feed air conduit passes.

4. The installation of claim 1, wherein the expansion circuit is derived from the first feed air conduit.

5. A method of operating a combined installation of at least one furnace and at least one air distillation apparatus producing oxygen for supplying to the furnace, comprising:

operating a blower to produce blast air at a first pressure supplied to the furnace, deriving from the blast air a feed air flux for supplying to the air distillation apparatus which comprises a medium pressure column and a mixing column, dividing the feed air flux into a first flux and a second flux, cooling the first flux to obtain a cooled first flux and passing the cooled first flux to the medium pressure column, boosting the second flux by a booster coupled to an expansion turbine to obtain a boosted second flux, cooling the boosted second flux to obtain a cooled boosted second flux and passing said cooled boosted second flux to the mixing column, imparting supplemental energy to the booster/turbine assembly to pass to the mixing column a boosted second flux at a pressure at least $0.3\times10^5$ Pa higher than the first pressure, and passing oxygen from the mixing column to the furnace.

6. The method of claim 5, wherein the supplemental energy is supplied to the booster/turbine to maintain the pressure of the boosted second flux between about $0.4\times10^5$ Pa and $0.8\times10^5$ Pa higher than the first pressure.

7. The method of claim 5, wherein the supplemental energy is electrical energy.

8. The method of claim 5, wherein the expansion turbine expands part of the first flux.

9. Apparatus for enriching blast air with oxygen comprising:

a blast air blower having an output line, an air distillation unit comprising at least one medium pressure column, one low pressure column and one mixing column coupled to the low pressure column, a feed air line derived from the output line and divided into a first feed air conduit for supplying air to the medium pressure column and into a second feed air conduit for supplying air to the mixing column, the second feed air conduit including a booster coupled to an expansion turbine and to an auxiliary power drive, means for withdrawing oxygen from the mixing column, and means for passing at least part of the withdrawn oxygen into a downstream portion of the output line.

* * * * *